US010834508B2

(12) United States Patent
Gomes et al.

(10) Patent No.: US 10,834,508 B2
(45) **Date of Patent: *Nov. 10, 2020**

(54) REINFORCED ACTUATORS FOR DISTRIBUTED MODE LOUDSPEAKERS

(71) Applicant: Google LLC, Mountain View, CA (US)

(72) Inventors: Rajiv Bernard Gomes, San Jose, CA (US); Mark William Starnes, Sunnyvale, CA (US); Anthony King, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/599,888

(22) Filed: Oct. 11, 2019

(65) Prior Publication Data

US 2020/0177998 A1 Jun. 4, 2020

Related U.S. Application Data

(63) Continuation of application No. 16/261,435, filed on Jan. 29, 2019, now Pat. No. 10,462,574.

(Continued)

(51) Int. Cl.
*H04R 9/06* (2006.01)
*H04R 9/04* (2006.01)

(Continued)

(52) U.S. Cl.
CPC ..... *H04R 9/04* (2013.01); *H04R 7/045* (2013.01); *H04R 9/025* (2013.01); *H04R 9/06* (2013.01);

(Continued)

(58) Field of Classification Search
CPC . H04R 7/045; H04R 9/04; H04R 9/06; H04R 9/066; H04R 2400/03;

(Continued)

(56) References Cited

U.S. PATENT DOCUMENTS 6,208,237 B1 * 3/2001 Saiki ..... H04M 1/03 340/388.1
6,332,029 B1 12/2001 Azima et al.

(Continued)

FOREIGN PATENT DOCUMENTS

CN 100998977 7/2007
JP 2016-150285 8/2016

(Continued)

OTHER PUBLICATIONS

PCT International Search Report and Written Opinion in International Appln. No. PCT/US2019/054564, dated Mar. 12, 2020, 21 pages.

(Continued)

*Primary Examiner* — Huyen D Le
(74) *Attorney, Agent, or Firm* — Fish & Richardson P.C.

(57) ABSTRACT

An actuator, attached to a panel extending in a plane, includes a frame and a magnetic circuit assembly that includes a magnet and a voice coil, the magnet and voice coil being moveable relative to each other during operation of the actuator along an axis perpendicular to the panel's plane. The actuator further includes one or more suspension members attaching the frame to a first component of the magnetic circuit assembly. Each suspension member includes a segment attaching the suspension member to the frame at an attachment point and a first arm extending away from the attachment point to an end attached to the first component of the magnetic circuit assembly. During operation of the actuator the first arm of the one or more suspension members flex to accommodate axial displacements of the magnet relative to the voice coil.

20 Claims, 9 Drawing Sheets

Related U.S. Application Data

(60) Provisional application No. 62/774,104, filed on Nov. 30, 2018.

(51) Int. Cl.
*H04R 9/02* (2006.01)
*H04R 7/04* (2006.01)

(52) U.S. Cl.
CPC ..... *H04R 2400/03* (2013.01); *H04R 2400/07* (2013.01); *H04R 2440/05* (2013.01); *H04R 2499/11* (2013.01); *H04R 2499/15* (2013.01)

(58) Field of Classification Search
CPC ..... H04R 2400/07; H04R 2440/05; H04R 2499/11; H04R 2499/15
USPC ..... 381/152, 396, 400, 401, 402, 403, 417, 381/431
See application file for complete search history.

(56) References Cited

U.S. PATENT DOCUMENTS

| | | | | |
|---|---|---|---|---|
| 6,570,993 | B1 * | 5/2003 | Fukuyama | G10K 9/22 381/396 |
| 6,618,487 | B1 * | 9/2003 | Azima | H04R 1/24 381/152 |
| 6,681,026 | B2 | 1/2004 | Kam | |
| 6,965,678 | B2 | 11/2005 | Bank | |
| 7,003,130 | B2 | 2/2006 | Chung et al. | |
| 7,382,079 | B2 | 6/2008 | Kawase | |
| 7,916,880 | B2 | 3/2011 | Starnes | |
| 8,994,247 | B2 | 3/2015 | Okamura et al. | |
| 9,117,468 | B1 | 8/2015 | Zhang et al. | |
| 9,621,994 | B1 | 4/2017 | Bongiovi et al. | |
| 9,743,166 | B2 | 8/2017 | Abe | |
| 10,462,574 | B1 * | 10/2019 | Gomes | H04R 9/04 |
| 10,476,461 | B2 | 11/2019 | Landick | |
| 2006/0140439 | A1 | 6/2006 | Nakagawa | |
| 2007/0053531 | A1 | 3/2007 | Ohta | |
| 2008/0080735 | A1 | 4/2008 | Grinnip, III | |
| 2009/0045700 | A1 | 2/2009 | Sasaki et al. | |
| 2010/0205699 | A1 | 8/2010 | Tachizaki | |
| 2011/0280433 | A1 | 11/2011 | Park | |
| 2012/0162143 | A1 | 6/2012 | Kai | |
| 2012/0169152 | A1 | 7/2012 | Li et al. | |
| 2015/0086047 | A1 | 3/2015 | Horii | |
| 2015/0243874 | A1 | 8/2015 | East | |
| 2018/0198052 | A1 | 7/2018 | Park | |
| 2020/0177997 | A1 | 6/2020 | Gomes et al. | |

FOREIGN PATENT DOCUMENTS

| | | |
|---|---|---|
| WO | WO 2006/003367 | 1/2006 |
| WO | WO 2013/047017 | 4/2013 |

OTHER PUBLICATIONS

PCT Invitation to Pay Additional Fees in International Appln. PCT/US2019/063769, dated Jan. 31, 2020, 11 pages.
PCT International Search Report and Written Opinion in International Appln. No. PCT/US2019/063769, dated Mar. 24, 2020, 20 pages.

* cited by examiner

REINFORCED ACTUATORS FOR DISTRIBUTED MODE LOUDSPEAKERS

CROSS-REFERENCE TO RELATED APPLICATIONS

This is a continuation of U.S. application Ser. No. 16/261,435, filed on Jan. 29, 2019, which claims priority to U.S. Provisional Application No. 62/774,104, filed on Nov. 30, 2018. The disclosures of the prior applications are considered part of and are incorporated by reference in the disclosure of this application.

BACKGROUND

This specification relates to distributed mode actuators (DMAs), electromagnetic (EM) actuators, and distributed mode loudspeakers that feature DMAs and EM actuators.

Many conventional loudspeakers produce sound by inducing piston-like motion in a diaphragm. Panel audio loudspeakers, such as distributed mode loudspeakers (DMLs), in contrast, operate by inducing uniformly distributed vibration modes in a panel through an electro-acoustic actuator. Typically, the actuators are piezoelectric or electromagnetic actuators.

During the operation of a typical actuator, components of the actuator bend, causing these components to experience mechanical stress. This stress may decrease the performance and lifetime of the actuator. Conventional DMAs and EM actuators featuring flexible components with fixed widths and conventional EM actuators having flexible components bent at right angles are particularly susceptible to decreased performance due to mechanical stress.

SUMMARY

Disclosed are improvements to conventional distributed mode actuators (DMAs) and electromagnetic (EM) actuators. For example, implementations of such DMAs and EM actuators feature flexible components with portions having increased dimensions compared to conventional devices. The portions having increased dimensions are strategically located in high stress regions. The components can also be shaped so that the increased dimension does not significantly increase the volume occupied by the actuator.

By attaching a DMA or an EM actuator to a mechanical load, such as an acoustic panel, the actuators can be used to induce vibrational modes in the panel to produce sound.

In general, in a first aspect, the invention features an actuator that includes a frame including a panel extending in a plane and one or more pillars extending perpendicular from the plane. The actuator also includes a magnetic circuit assembly that includes a magnet and a voice coil, the magnet and voice coil being moveable relative to each other during operation of the actuator along an axis perpendicular to the plane of the panel. The actuator further includes one or more suspension members attaching the frame to a first component of the magnetic circuit assembly. Each suspension member includes a vertical segment extending in an axial direction attaching the suspension member to a corresponding one of the pillars. Each suspension member further includes a first arm extending away from the corresponding pillar in a first plane, parallel to the panel's plane to an end attached to the first component of the magnetic circuit assembly. During operation of the actuator the first arm of the suspension member flexes to accommodate axial displacements of the magnet relative to the voice coil.

Embodiments of the actuator can include one or more of the following features and/or one or more features of other aspects. For example, a thickness of the first arm in the first plane can be varied to reduce a concentration of stress at one or more locations of the suspension member when the suspension member flexes during operation of the actuator.

In some embodiments, the first arm can include a first straight segment extending away from the corresponding pillar in a first direction in the first plane and a second straight segment connected to the first arm, the second straight segment extending in the first plane orthogonal to the first direction. The first arm can include a first curved segment connecting the first straight segment and the second straight segment. The second straight segment can have a thickness in the first plane that is tapered along the length of the second straight segment. The first arm can include a third straight segment connected to the second straight segment by a second curved segment, the third straight segment extending in the first plane orthogonal to the second straight segment and the third straight segment being attached to the first component of the magnetic circuit assembly.

In some embodiments, the second curved segment has a first radius of curvature along an outer edge that is smaller than a second radius of curvature along an inner edge of the second curved segment.

In some embodiments, each suspension member includes a second arm extending away from the corresponding pillar in a second plane parallel to the panel's plane to an end attached to the first component of the magnetic circuit assembly. The first and second arms can be respectively connected to opposing ends the vertical segment by a corresponding curved segment, the corresponding curved segments extending out of the first and second planes, respectively. The vertical segment and two curved segments can collectively form a C-shaped segment. The curved segments can be free from the corresponding pillar of the frame.

In some embodiments, the first and second arms can be connected by the vertical segment of the suspension member. The ends of the first and second arms can be respectively attached to opposite sides of the first component of the magnetic circuit assembly.

In some embodiments, the first component of the magnetic circuit assembly has a substantially polygonal shape in the plane of the frame and a corresponding suspension member is attached to each respective side of the polygon. The polygon can be a quadrilateral.

In some embodiments, the voice coil is attached to the frame and the first component of the magnetic circuit assembly includes the magnet.

In another aspect, the invention features a panel audio loudspeaker that includes the actuator of the first aspect. The panel of the panel audio loudspeaker can include a display panel.

In another aspect, the invention features a mobile device that includes an electronic display panel extending in a plane. The mobile device can also include a chassis attached to the electronic display panel and defining a space between a back panel of the chassis and the electronic display panel. The mobile device can further include an electronic control module housed in the space, and the electronic control module can include a processor. In addition, the mobile device can include an actuator housed in the space and attached to a surface of the electronic display panel. The actuator can include a frame including a panel extending in a plane and one or more pillars extending perpendicular from the plane. The actuator can also include a magnetic circuit assembly that includes a magnet and a voice coil, the magnet and voice coil being moveable relative to each other during operation of the actuator along an axis perpendicular to the plane of the panel. The actuator can further include one or more suspension members attaching the frame to a first component of the magnetic circuit assembly. Each suspension member can include a vertical segment extending in an axial direction attaching the suspension member to a corresponding one of the pillars. Each suspension member can also include a first arm extending away from the corresponding pillar in a first plane, parallel to the panel's plane to an end attached to the first component of the magnetic circuit assembly. During operation of the actuator the first arm of the suspension member flexes to accommodate axial displacements of the magnet relative to the voice coil.

In another aspect, the invention features a wearable device that includes an electronic display panel extending in a plane. The wearable device can also include a chassis attached to the electronic display panel and defining a space between a back panel of the chassis and the electronic display panel. The wearable device can further include an electronic control module housed in the space, and the electronic control module can include a processor. In addition, the wearable device can include an actuator housed in the space and attached to a surface of the electronic display panel. The actuator can include a frame including a panel extending in a plane and one or more pillars extending perpendicular from the plane. The actuator can also include a magnetic circuit assembly that includes a magnet and a voice coil, the magnet and voice coil being moveable relative to each other during operation of the actuator along an axis perpendicular to the plane of the panel. The actuator can further include one or more suspension members attaching the frame to a first component of the magnetic circuit assembly. Each suspension member can include a vertical segment extending in an axial direction attaching the suspension member to a corresponding one of the pillars. Each suspension member can also include a first arm extending away from the corresponding pillar in a first plane, parallel to the panel's plane to an end attached to the first component of the magnetic circuit assembly. During operation of the actuator the first arm of the suspension member flexes to accommodate axial displacements of the magnet relative to the voice coil.

Among other advantages, embodiments include actuators that have a decreased chance of failure from mechanic stress caused by bending when compared to conventional actuators.

Another advantage is that the actuator occupies substantially the same space as conventional actuators. This can be particularly beneficial where an actuator is integrated into a larger electronic device and is required to fit within a prescribed volume.

Other advantages will be evident from the description, drawings, and claims.

BRIEF DESCRIPTION OF THE DRAWINGS

Like reference symbols in the various drawings indicate like elements.

DETAILED DESCRIPTION

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104 including a flat panel display (e.g., an OLED or LCD display panel) that integrates a panel audio loudspeaker. Mobile device 100 interfaces with a user in a variety of ways, including by displaying images and receiving touch input via touch panel display 104. Typically, a mobile device has a depth of approximately 10 mm or less, a width of 60 mm to 80 mm (e.g., 68 mm to 72 mm), and a height of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a DMA or EM actuator. The actuator is a movable component arranged to provide a force to a panel, such as touch panel display 104, causing the panel to vibrate. The vibrating panel generates human-audible sound waves, e.g., in the range of 20 Hz to 20 kHz.

In addition to producing sound output, mobile device 100 can also produces haptic output using the actuator. For example, the haptic output can correspond to vibrations in the range of 180 Hz to 300 Hz.

Figure 1:
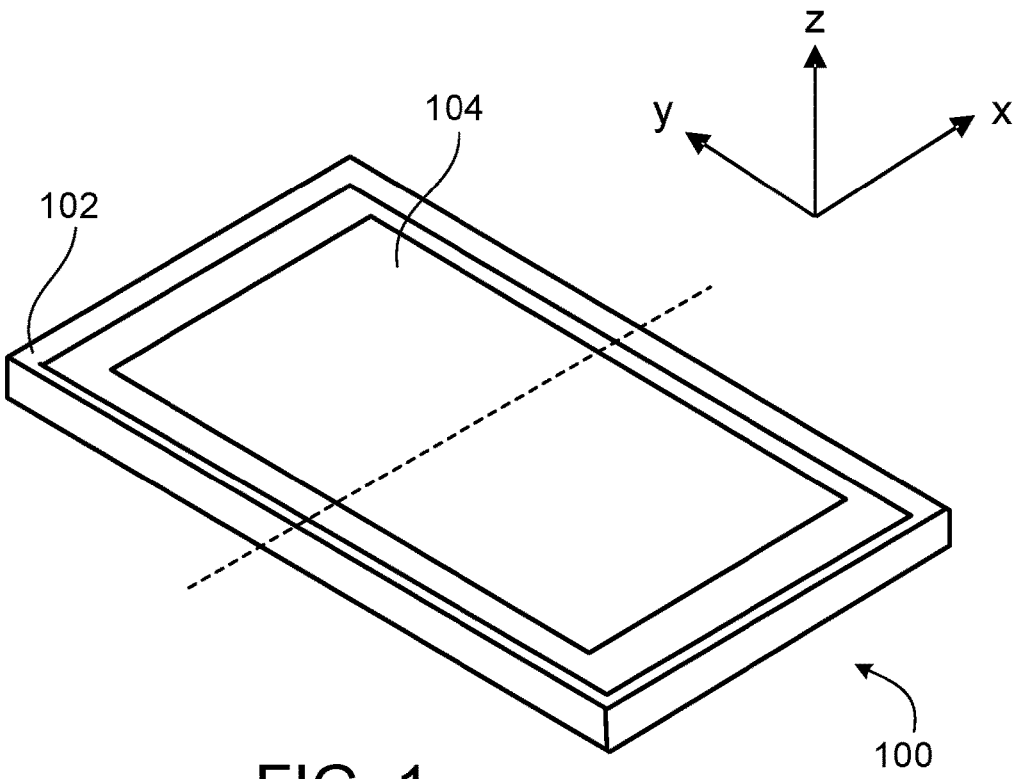
FIG. 1 is a perspective view of an embodiment of a mobile device.
Figure 2:
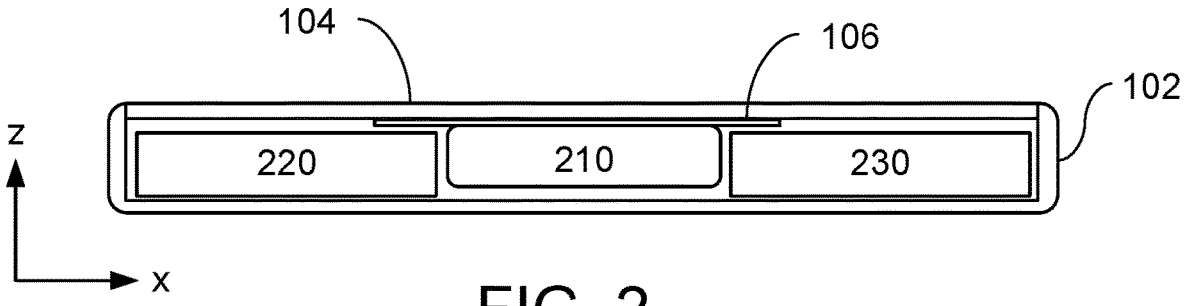
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section of mobile device 100 illustrates device chassis 102 and touch panel display 104. FIG. 2 also includes a Cartesian coordinate system with X, Y, and Z axes, for ease of reference. Device chassis 102 has a depth measured along the Z-direction and a width measured along the X-direction. Device chassis 102 also has a back panel, which is formed by the portion of device chassis 102 that extends primarily in the XY-plane. Mobile device 100 includes an actuator 210, which is housed behind display 104 in chassis 102 and affixed to the back side of display 104. Generally, actuator 210 is sized to fit within a volume constrained by other components housed in the chassis, including an electromechanical module 220 and a battery 230.

In general, actuator 210 includes a frame that connects the actuator to display panel 104 via a plate 106. The frame serves as a scaffold to provide support for other components of actuator 210, which commonly include a flexure and an electromechanical module.

The flexure is typically an elongate member that extends in the X-Y plane, and when vibrating, is displaced in the Z-direction. The flexure is generally attached to the frame at at least one end. The opposite end can be free from the frame, allowed to move in the Z-direction as the flexure vibrates.

The electromechanical module is typically a transducer that transforms electrical signals into a mechanical displacement. At least a portion of the electromechanical module is usually rigidly coupled to the flexure so that when the electromechanical module is energized, the module causes the flexure to vibrate.

Generally, actuator 210 is sized to fit within a volume constrained by other components housed in mobile device 100, including electronic control module 220 and battery 230. Actuator 210 can be one of a variety of different actuator types, such as an electromagnet actuator or a piezoelectric actuator.

Figure 3A:
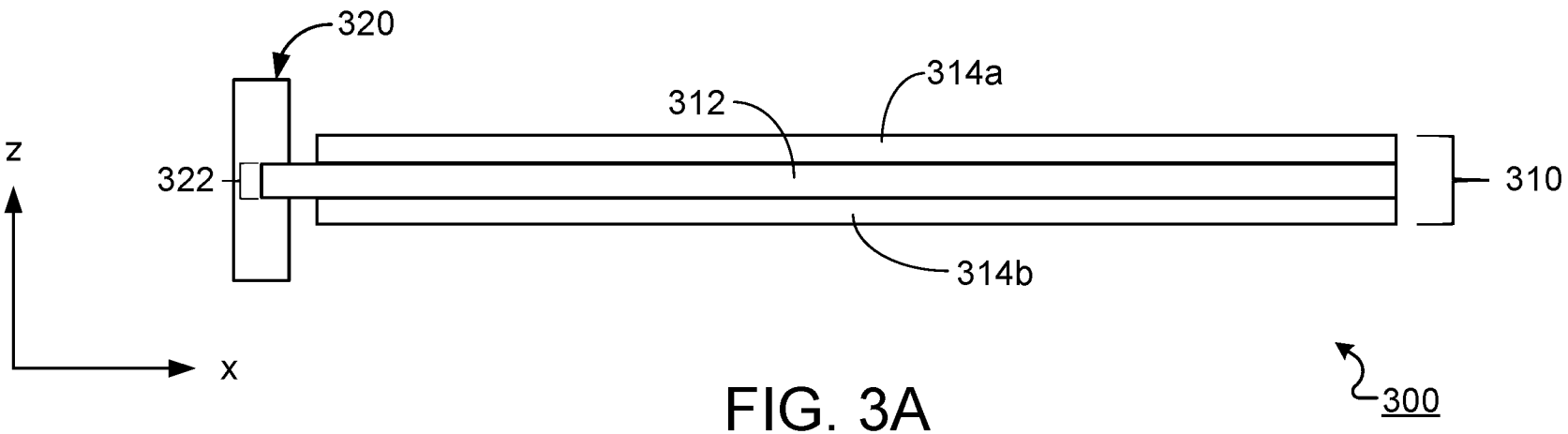
FIG. 3A is a cross-sectional view of a DMA having a flexure in a first plane.
Figure 3B:
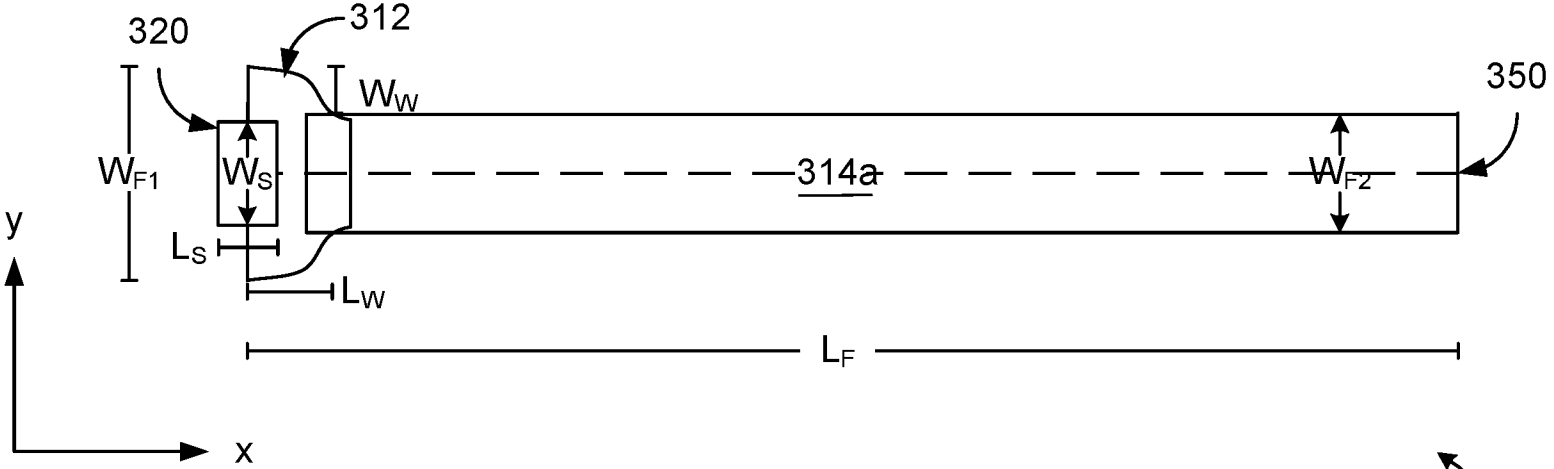
FIG. 3B is a top view of the DMA of FIG. 3A.

Turning now to specific embodiments, in some implementations the actuator is a distributed mode actuator (DMA). For example, FIGS. 3A and 3B show different views of a DMA 300, which includes an electromechanical module and a flexure. FIG. 3A is a cross-section of DMA 300, while FIG. 3B is a top-view of DMA 300. During operation of DMA 300, the electromechanical module displaces a free end of the flexure in the Z-direction.

Referring specifically to FIG. 3A, in DMA 300, the electromechanical module and flexure are integrated together into a cantilevered beam 310 that includes a vane 312 and piezoelectric stacks 314*a* and 314*b*. Vane 312 is an elongate member that is attached at one end to frame 320, which is a stub that attaches the vane to plate 106. Vane 312 extends from frame 320, terminating at an unattached end that is free to move in the Z-direction. The portion of vane 312 that is attached to frame 320 has a width, measured in the Y-direction, which is greater than the width of the portion of the flexure that is unattached. Beam 310 is attached to frame 320 at a slot 322 into which vane 312 is inserted. In the examples of FIGS. 3A and 3B, piezoelectric stacks 314*a* and 314*b* are disposed above and below vane 312, respectively. Each stack 314*a* and 314*b* can include one or more piezoelectric layers.

While FIG. 3A shows a cross-section of DMA 300, FIG. 3B shows a top view of the DMA. FIG. 3A includes a top view of vane 312, which is partially obscured by frame 320 and piezoelectric stack 314*a*. Vane 312 and piezoelectric stacks 314*a* and 314*b* all extend parallel to the XY-plane. When DMA 300 is at rest, beam 310, i.e., vane 312 and piezoelectric stacks 314*a* and 314*b*, remains parallel to the XY-plane. During the operation of DMA 300, piezoelectric stacks 314*a* and 314*b* are energized, causing beam 310 to vibrate relative to the Z-axis. The vibration of vane 312 beam 310 causes it to move in the ±Z-directions.

The length of vane 312 measured in the X-direction is denoted $L_F$, and is also called the end-to-end extension. FIG. 3B also shows a length $L_W$, which is discussed in greater detail below with regard to the wings of the flexure. The free end of vane 312 has a width $W_{F2}$. The width of vane 312 remains $W_{F2}$ for the length $L_F$-$L_W$.

The end of vane 312, anchored by frame 320 has a first width $W_{F1}$, which is greater than the width of the frame 320, denoted $W_S$. Towards the anchored end, the width of vane 312 increases to form two wings that extend laterally from slot 322. In this implementation, the wings are symmetric about a central axis 350 that runs in the X-direction and divides vane 312 into symmetric top and bottom portions, although in other implementations, the wings need not be symmetric. Referring to the top wing (i.e., the wing above central axis 350), the edges of the wing are contiguous with the edge of the top portion of vane 312 that is parallel to the X-axis. The width of the top wing, denoted $W_W$, is measured from the top edge of vane 312, to the point of the wing farthest from central axis 350. The width of either wing, $W_W$, the width of the free end of the flexure, $W_{F2}$, and the width of the anchored end of the flexure, $W_{F1}$, are related by the equation, $W_{F1}=W_{F2}\ 2W_W$.

Each wing also has a length, denoted $L_W$. In the implementation shown in FIGS. 3A and 3B, $L_W$ is greater than $W_W$, although in other implementations, $L_W$ can be less than or equal to $W_W$. For example, $L_W$ and $W_W$ can be on the order of approximately 2 mm to 10 mm, e.g., 4 mm to 8 mm, such as about 5 mm.

The width of slot 322 is proportioned to be larger than the width of the wings. For example, $W_S$ can be two or more times $W_W$, three or more times $W_W$, or four or more times $W_W$. The height of slot 322, as measured in the Z-direction, is approximately equal to the height of vane 312, which can be approximately 0.1 to 1 mm, e.g., 0.2 mm to 0.8 mm, such as 0.3 mm to 0.5 mm.

In general, the gap between frame 320 and piezoelectric stacks 314*a* and 314*b* is smaller than either $L_W$ or $W_W$. For example, the gap can be one half or less of $L_W$ or $W_W$, one third or less of $L_W$ or $W_W$, or one fifth or less of $L_W$ or $W_W$.

In the example of FIG. 3B, the width of slot 322, $W_S$, is smaller than the width of vane 312 at the free end, $W_{F2}$. However, in some implementations, $W_S$ is larger than $W_{F2}$.

The wings of vane 312 extend on either side of frame 320 to distribute mechanical stress that results from the operation of DMA 300. The dimensions of the wings can be chosen such that the wings most effectively distribute stress. For example $L_F$ can be on the order of approximately 150 μm or more, 175 μm or more, or 200 μm or more, such as about 1000 μm or less, 500 μm or less. As another example, $W_W$ can be 4 μm or more, 6 μm or more, or 8 μm or more, such as about 50 μm or less, 20 μm or less.

The shape of the wings is chosen to improve (e.g., optimize) the distribution of stress. For example, when viewed from above, as in FIG. 3B, the shape of each wing can be a rectangle, a half circle, or a half ellipse.

Figure 4A:
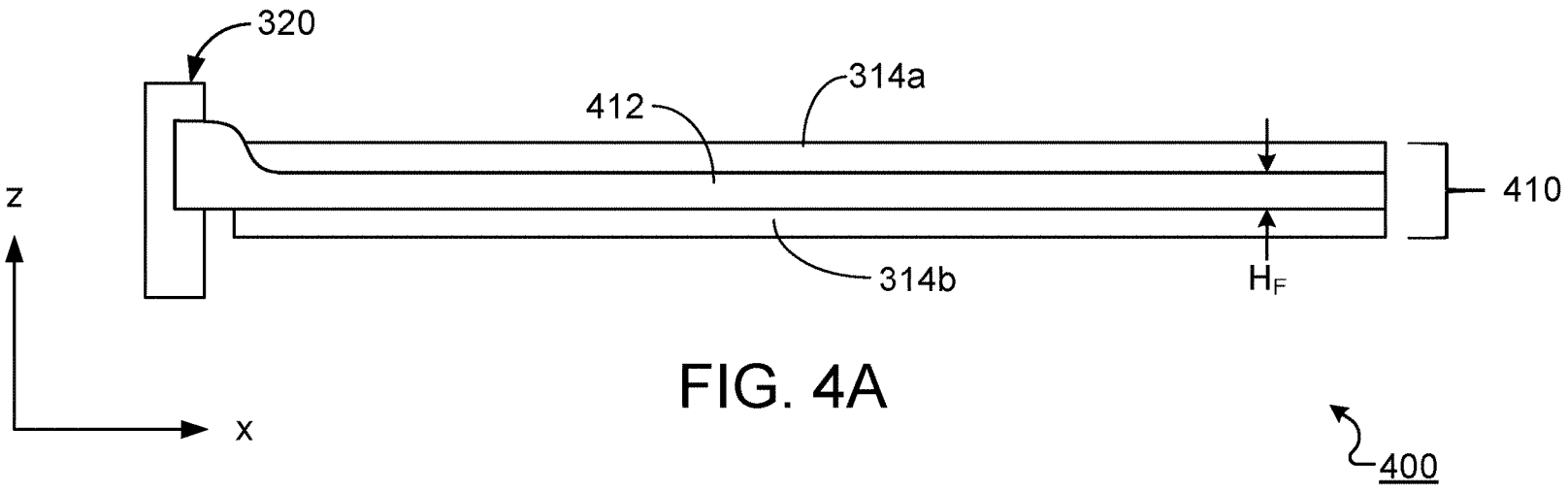
FIG. 4A is a cross-sectional view of a DMA having a flexure partially folded into a second plane, different from the first plane of FIG. 3A.
Figure 4B:
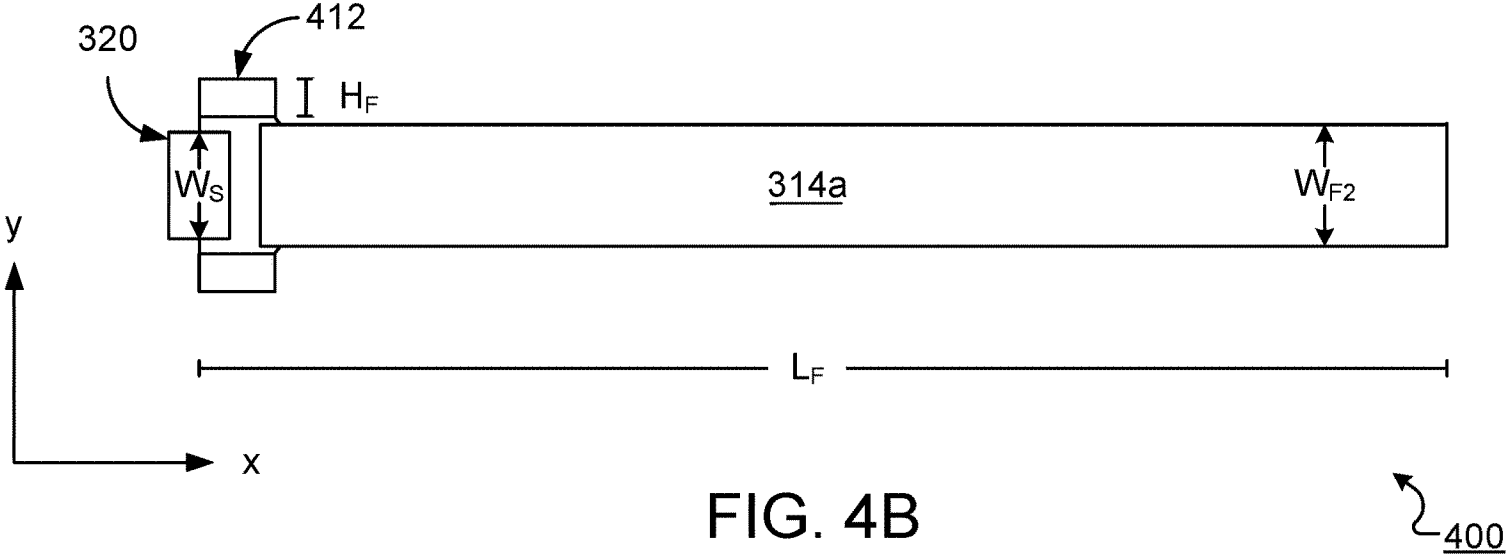
FIG. 4B is a top view of the DMA of FIG. 4A.

While FIGS. 3A and 3B show an implementation of a DMA having a flexure with two wings that are in the plane of the flexure when the DMA is at rest, other implementations include wings that are not in the plane of the flexure when the DMA is at rest. FIGS. 4A and 4B show a cross-section and side view of a DMA 400 that includes wings folded out of the XY-plane.

DMA 400 includes a beam 410 connected to frame 320. Like beam 310 of FIGS. 3A and 3B, beam 410 includes an electromechanical module and a flexure, which are integrated together into a cantilevered beam 410 that includes a vane 412 and piezoelectric stacks 314*a* and 314*b*. Similar to vane 312, vane 412 includes a portion that extends primarily in the XY-plane. However, in addition to the portion that extends primarily in the XY-plane, vane 412 also includes two wings that are folded out of the XY-plane and extend such that the extending portion forms a plane parallel to the XZ-plane.

In the example of FIGS. 4A and 4B, vane 412 includes one or more materials that are formed into an extruded plane having a height $H_F$, as shown in FIG. 4A. Portions of the plane are then shaped to form the wings of vane 412.

Because the wings of vane 412 are folded out of the XY-plane, the width of the wings, as measured in the Y-direction, is equal to the height of the flexure, $H_F$. Accordingly, the width of the top wing is labeled $H_F$. In other implementations, the height of vane 412 can be greater than $H_F$, such that the width of the portion of the flexure surrounding the stub is greater than $H_F$.

Like the wings of vane 312, those of vane 412 contribute to the distribution of stress experienced by the vane during the operation of DMA 400. One difference between vane 312 and 412, is that the latter can distribute stress on DMA 400 while occupying a smaller volume than the former. In systems that include multiple components occupying a limited space, it is advantageous to reduce the volume of the multiple components. For example, the electrical components housed in a mobile device must all fit within the limited space of the chassis of the mobile device. Therefore, the smaller volume occupied by vane 412, when compared to vane 312, is advantageous, although the functional performance of the two vanes is approximately the same.

The one or more piezoelectric layers of piezoelectric stacks 314*a* and 314*b* may be any appropriate type of piezoelectric material. For instance, the material may be a ceramic or crystalline piezoelectric material. Examples of ceramic piezoelectric materials include barium titanate, lead zirconium titanate, bismuth ferrite, and sodium niobate, for example. Examples of crystalline piezoelectric materials include topaz, lead titanate, barium neodymium titanate, potassium sodium niobate (KNN), lithium niobate, and lithium tantalite.

Vanes 312 and 412 may be formed from any material that can bend in response to the force generated by piezoelectric stacks 314*a* and 314*b*. The material that forms vanes 312 and 412 should also being sufficiently rigid to avoid being substantially deformed as a result of bending. For example, vanes 312 and 412 can be a single metal or alloy (e.g., iron-nickel, specifically, NiFe42), a hard plastic, or another appropriate type of material. The material from which vane 312 is formed should have a low CTE mismatch.

While in some implementations, the actuator 210 is a distributed mode actuator, as shown in FIGS. 3A-3B and 4A-4B, in other implementations, the actuator is an electromagnetic (EM) actuator. Like a DMA, an EM actuator transfers mechanical energy, generated as a result of the actuator's movement, to a panel to which the actuator is attached.

In general, an EM actuator includes a magnetic circuit assembly, which in turn includes a magnet and a voice coil. The EM actuator also includes one or more suspension members that attach the magnetic circuit assembly to a frame. The frame includes one or more pillars each attached to a suspension member along a vertical segment of the suspension member. In addition to the vertical segment, each suspension member also includes an arm that extends perpendicularly from a respective pillar and is attached at one end to the magnetic circuit assembly.

Figure 5A:
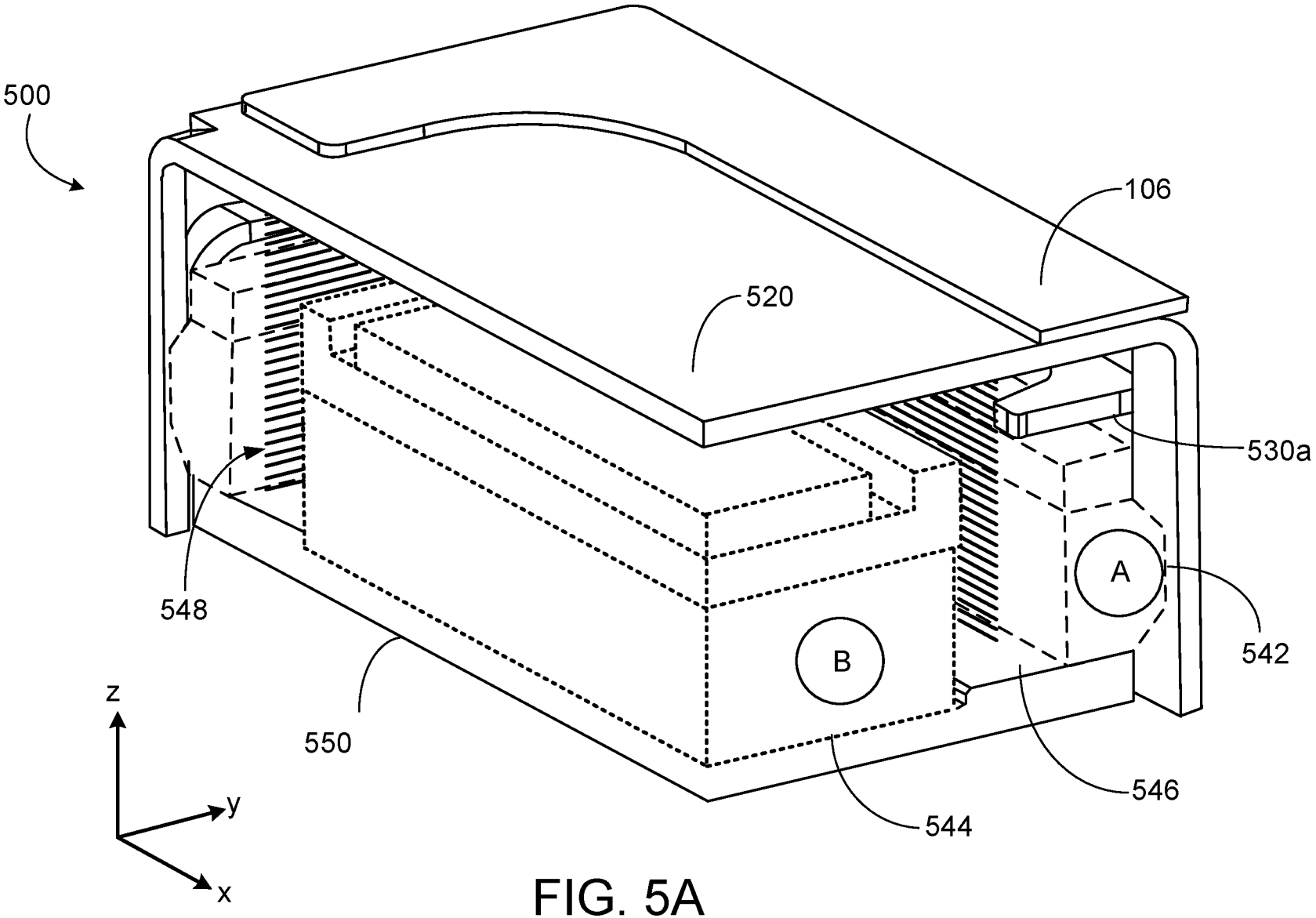
FIG. 5A is a perspective quarter-cut view of an EM actuator.
Figure 5B:
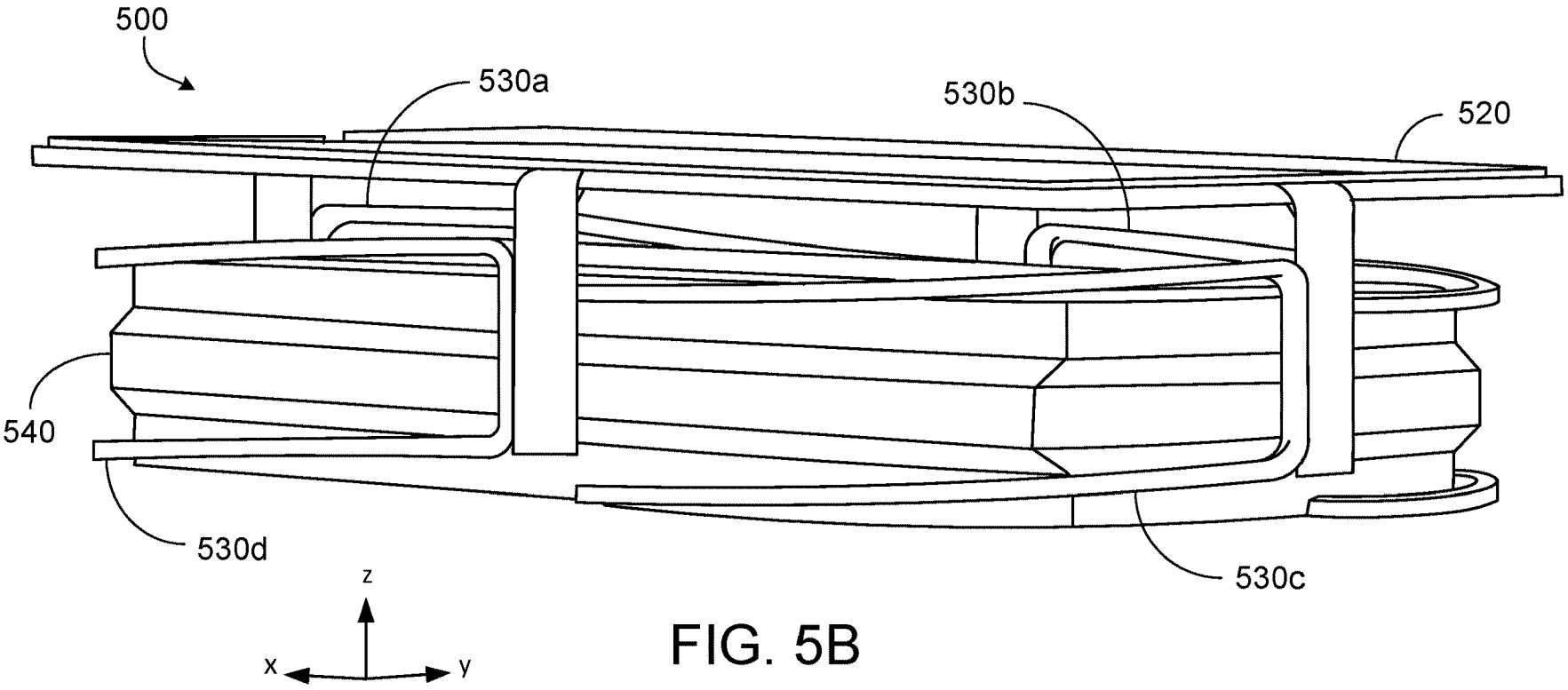
FIG. 5B is a perspective view of the EM actuator of FIG. 5A.

An embodiment of an EM actuator 500 is shown in FIGS. 5A and 5B. Referring to FIGS. 5A and 5B, EM actuator 500 is shown in a perspective quarter cut view and a different perspective view, respectively. FIG. 5A shows EM actuator 500 at rest, whereas FIG. 5B shows the actuator during operation.

EM actuator 500 includes a frame 520, which connects the actuator to panel 106. Referring to FIGS. 5A and 5B, EM actuator 500 further includes an outer magnet assembly 542, an inner magnet assembly 544, and a voice coil 546, which collectively form a magnetic circuit assembly 540. Outer magnet assembly 542, which is outlined in dashed lines, includes a ring magnet labeled "A" and a structural element positioned above the magnet A. Inner magnet assembly 544, which is outlined in dotted lines, includes an inner magnet labeled "B" and a structural element positioned above the magnet B. Both magnets A and B are attached to a bottom plate 550.

Figure 5C:
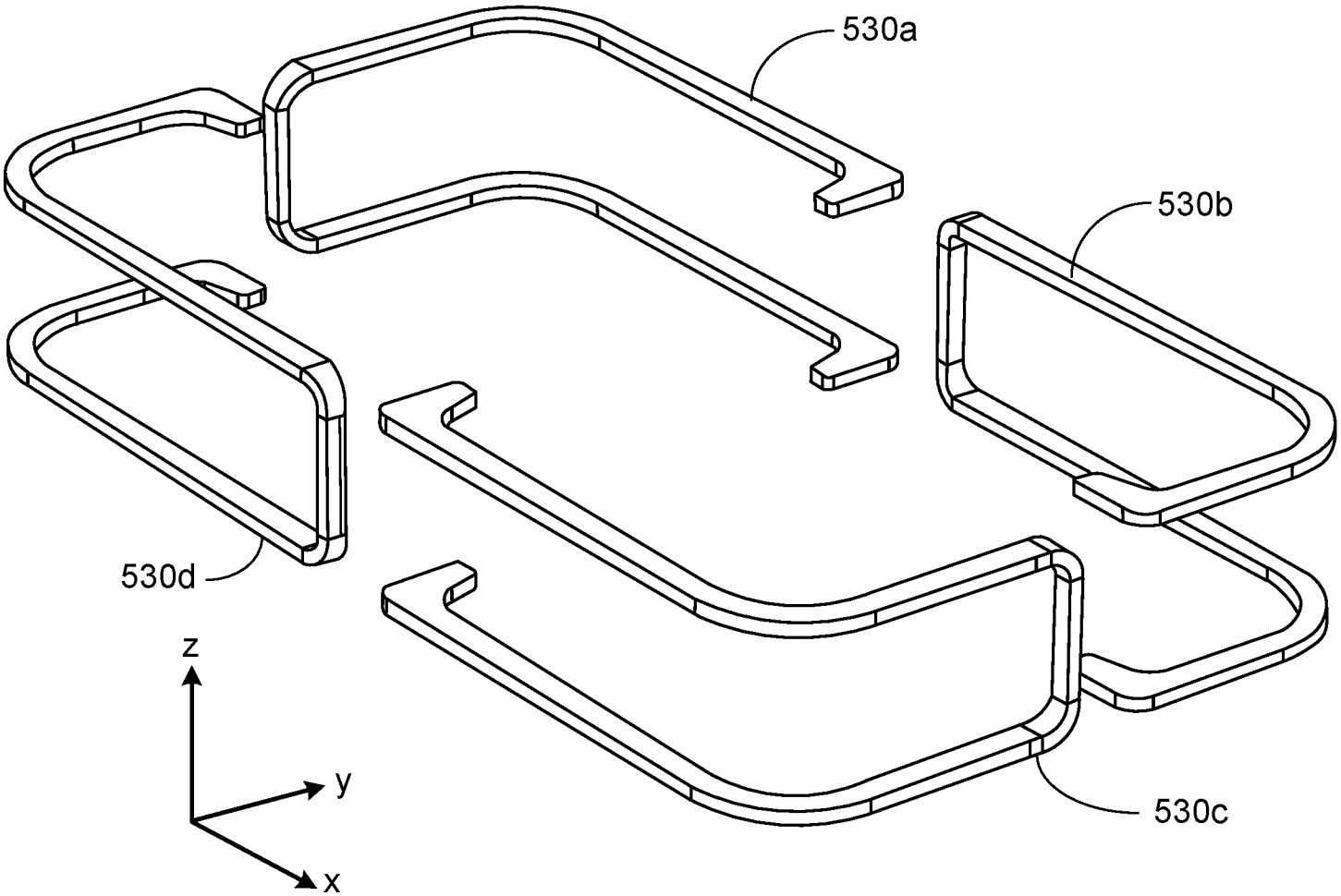
FIG. 5C is a perspective, isolated view of flexures of the EM actuator shown in FIGS. 5A and 5B.

While, in the example of FIG. 5A, EM actuator 500 includes multiple magnets A and B, in other implementations, actuators can include only a single magnet, e.g., either magnet A or magnet B. Flexures 530*a*, 530*b*, 530*c*, and 530*d* suspend outer magnet assembly 542 from frame 520. Flexures 530*a*-530*d* each connect to a separate portion of the structural element of outer magnet assembly 542. While FIGS. 5A and 5B show how flexures 530*a*-530*d* are integrated into EM actuator 500, FIG. 5C shows a perspective, isolated view of the flexures.

Between outer magnet assembly 542 and inner magnet assembly 544, is an air gap 546. Voice coil 548 is attached to frame 520 and is positioned in air gap 546. During the operation of EM actuator 500, voice coil 548 is energized, which induces a magnetic field in air gap 546. Because magnet assembly 542, is positioned in the induced magnetic field and has a permanent axial magnetic field, parallel to the Z-axis, the magnet assembly experiences a force due to the interaction of its magnetic field with that of the voice coil. Flexures 530*a*-530*d* bend to allow electromechanical module 540 to move in the Z-direction in response to the force experienced by magnet assembly 542. FIG. 5B shows an example of how flexures 530*a*-530*d* bend during the operation of EM actuator 500.

Frame 520 includes a panel that extends primarily in the XY-plane and four pillars that extend primarily in the Z-direction. Each of the four pillars have a width measured in the X-direction that is sized to allow it to attach to one of flexures 530*a*-530*d*. Although in this implementation, EM actuator 500 includes four pillars, each connected to one of flexures 530*a*-530*d*, in other implementations, the actuator can include more than four flexures connected to an equal number of pillars, while in yet other implementations, the actuator can include less than four flexures connected to an equal number of pillars.

Flexures 530*a*-530*d* include vertical segments extending in the Z-direction, which attach the flexures to the pillars of frame 520. FIG. 5B shows flexures 530*c* and 530*d* each connected to a respective pillar. Each of the vertical portions of the flexures extend a height of the pillar to which they are attached. For example, the vertical portions of the flexures can extend at least 10% (at least 20%, at least 30%, at least 40%, at least 50%, at least 60%, at least 70%, at least 80%) of the height of each pillar. As another example, the second portions can extend 0.5 mm or more (0.8 mm or more, 1 mm or more, 1.25 mm or more, 1.5 mm or more, 2 mm or more, 2.5 mm or more, 3 mm or more) in the Z-direction. The flexures can be attached to the pillars using an adhesive, a weld, or other physical bond.

Figure 6:
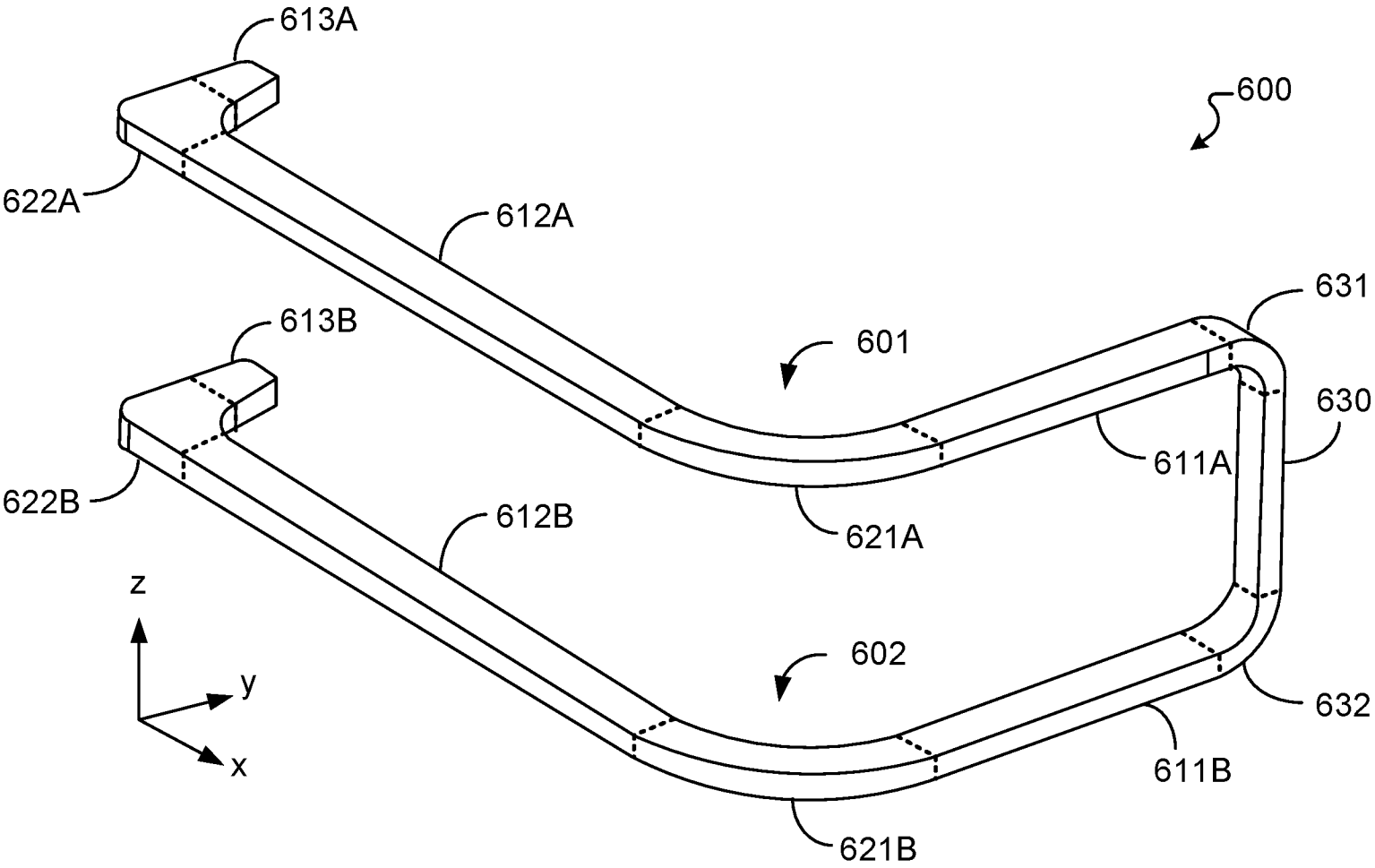
FIG. 6 is a perspective view of an example flexure of an EM actuator.

Turning now to the structure of the flexures, FIG. 6 shows a perspective view of a single flexure 600. Although FIG. 6 shows flexure 600, the discussion of the flexure also describes flexures 530*a*-530*d*.

Flexure 600 includes two arms 601 and 602, both extending parallel to the XY plane. First arm 601 includes a first straight segment 611A bounded by dotted lines and extending in the Y-direction. A second straight segment 612A of first arm 601 extends in the X-direction. First arm 601 further includes a first curved segment 621A that connects first straight segment 611A and second straight segment 612A. A third straight segment 613A of first arm 601 extends in the Y-direction. Second straight segment 612A is connected to third straight segment 613A by a second curved segment 622A.

Second arm 602 is parallel and identical to first arm 601. Second arm 602 includes a first straight segment 611B connected to a second straight segment 612B by a first curved segment 621B. Additionally, second arm 602 includes a third straight segment 613B connected to second straight segment 612B by a second curved segment 622B. Although no magnet assembly is shown, third straight segments 613A and 613B are each connected to opposite sides of the magnet assembly. That is, the third straight segment of the first arms of each flexure 630*a*-630*d* connect to the structural element positioned above the magnet A, while the third straight segment of the second arms of each flexure 630*a*-630*d* connect to bottom plate 550. The structural element positioned above magnet A has a substantially polygonal shape, e.g., a quadrilateral shape.

Flexure 600 includes a vertical segment 630. Vertical segment 630 extends perpendicular to the first and second arms 601 and 602. A first arm connector 631 attaches first arm 601 to vertical segment 630, while a second arm connector 632 attaches second arm 602 to vertical segment 630. Both connectors 631 and 632 are curved such that each the connectors along with vertical segment 630 collectively form a C-shaped segment.

As described above with regard to FIG. 5B, flexures 530*a*-530*d* bend to allow electromechanical module 540 to move in the Z-direction. In general, portions of a flexure that bend during the operation of an actuator system will experience a higher mechanical stress than portions that do not bend. A flexure may therefore be susceptible to breaking or plastic deformation at the bending portions as a result of the stress.

Figure 7B:
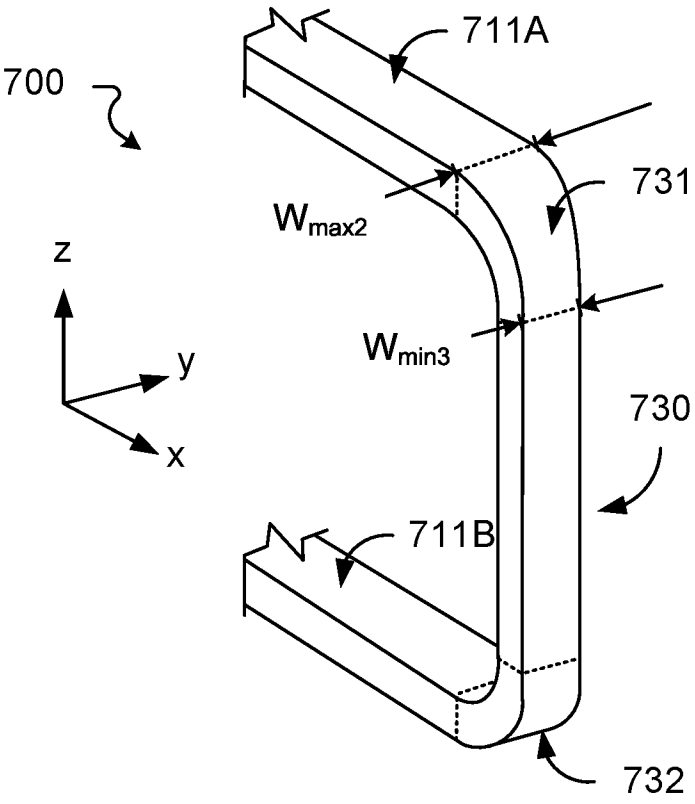
FIG. 7B is a perspective view of the flexure of FIG. 7A.
Figure 7A:
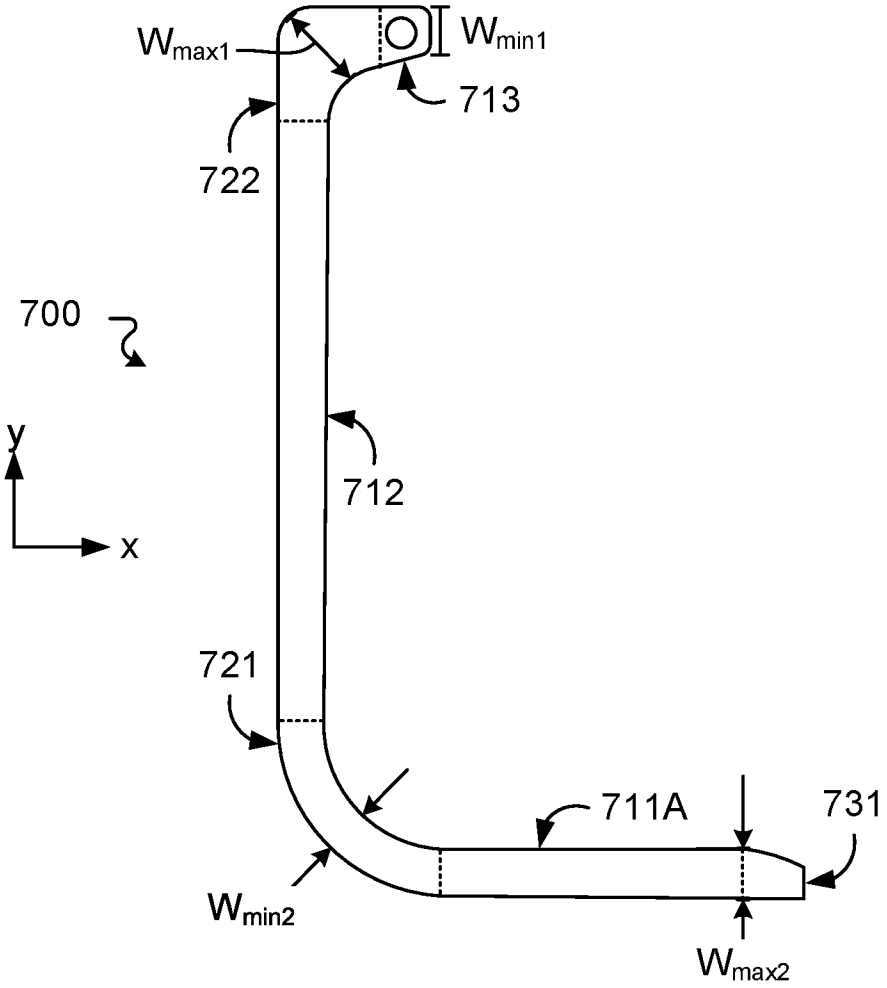
FIG. 7A is a top view of a first arm of a flexure.

Accordingly, the width of a flexure can be increased at locations that experience higher stress in order to reduce failure at these points. For example, flexures 530*a*-530*d* do not have a fixed width. Instead, to reduce the chances of failure, flexures 530*a*-530*d* have a maximum width at the bending portions. FIGS. 7A and 7B are enlarged views of a flexure 700, which show the increased width of the flexure at the bending portions. As discussed above, each flexure 530*a*-530*d* is identical to one another. Therefore, the following discussion that references flexure 700, also describes the features of flexures 530*a*-530*d*.

FIG. 7A is a top view of the first arm of flexure 700. The dotted lines show the boundaries of the segments of flexure 700, namely a third segment 713, a second curved segment 722, a second straight segment 712, first curved segment 721, first straight segment 711A, and first arm connector 731.

The free end of the third straight segment of flexure 700 has a first width denoted $W_{min1}$, which is measured from the bottom or outside edge of third straight segment 713 to the top or inside edge of the third straight segment. Although not shown in FIG. 7A or 7B, each third straight segment of flexure 700 is attached to a magnet assembly. A circle positioned on third straight segment 713 represents an example position of a connection between flexure 700 and the magnet assembly. For example, the circle can be the position of a weld, screw, adhesive, or other type of connection. $W_{min1}$ can be about 0.5 mm to about 0.7 mm, e.g. 0.55 mm, 0.6 mm, 0.65 mm.

While the third straight segments of flexure 700 is attached to the magnet assembly, second curved segment 722 extends away from the connection with the magnet assembly. When the magnet assembly moves along the Z-axis during the operation of the EM actuator, second curved segment 722 also moves along the Z-axis. To accommodate the movement of the magnet assembly, second curved segment 722 also bends along the Z-axis. The bending along the Z-axis causes second curved segment 722 to experience mechanical stress.

Moving counterclockwise from the free end of third straight segment 713, the width of the first portion increases until it reaches a maximum width, $W_{max1}$, which can be about 1.4 mm to about 1.6 mm, e.g., 1.45 mm, 1.5 mm, 1.55 mm. As discussed above, the location of $W_{max1}$ corresponds to a portion of second curved segment 722 that experiences higher stress during the operation of the EM actuator, as compared to the average stress experienced by flexure 700. The increased width at second curved segment 722 reinforces the flexure so that it is less likely to fail during the operation of the EM actuator. More specifically, during operation of the actuator, second curved segment 722 twists as a result of the portion closest to the boundary with third straight segment 713 being displaced by an amount that is different from the displacement of the portion closest to second straight segment 712. Stress focuses at the twisting location, causing fatigue of the flexure. By maximizing $W_{max1}$, the structural stiffness of second curved segment 722 is maximized, and as a result the twisting motion of the segment is minimized.

Second curved segment 722 has a first radius of curvature along an outer edge that is smaller than a second radius of curvature along an inner edge of the second curved segment. Both the rounded bend and the increased width of second curved segment 722 serve to reduce the stress experienced by flexure 700, by redistributing the stress on the flexure from higher than average stress areas to lower than average stress areas.

Similarly to the rounded bend of second curved segment 722, the curvature of first curved segment 722 also serves to reduce the stress experienced by flexure 700. The width of first curved segment 721 has a width labeled $W_{min2}$. $W_{min2}$ can be about 0.4 mm to about 0.6 mm, e.g., 0.45 mm, 0.5 mm, 0.55 mm. Moving counterclockwise from $W_{max1}$ to $W_{min2}$, the width of the flexure gradually decreases. Continuing counterclockwise from $W_{min2}$ to the edge of the first arm connector 731, the width of the flexure gradually increases to a width $W_{max2}$, measured at the boundary between first straight segment 711A and first arm connector 731. $W_{max2}$ can be about 0.7 to about 0.9 mm, e.g., 0.75 mm, 0.8 mm, 0.85 mm.

Referring to FIG. 7B, a perspective view of flexure 700 includes first straight segment 711A connected to a vertical segment 730 by first arm connector 731. The perspective view also includes third portion first straight segment 711B connected to vertical portion 730 by second arm connector 731. First arm connector 731 and second arm connector 732 are curved to distribute the stress experienced by these elements across the entirety of their respective curvatures.

During operation of the actuator, the ends of first and second arm connectors 731 and 732 that are closest to first straight segments 711A and 711B experience a greater displacement in the Z-direction compared to the ends that are closest to the vertical segment 730, due to bending of the second and first arm connectors. By virtue of their positions, first and second arm connectors 731 and 732 experience greater stress than the average stress experienced by flexure 700. To reduce the likelihood of first and second arm connectors 731 and 732 failing due to stress, the width of the connectors increases from a width $W_{min3}$, measured at the boundary between the first or second arm connectors and vertical segment 730, to the width $W_{max2}$. $W_{min3}$ can be about 0.4 mm to about 0.6 mm, e.g., 0.45 mm, 0.5 mm, 0.55 mm.

Figure 8:
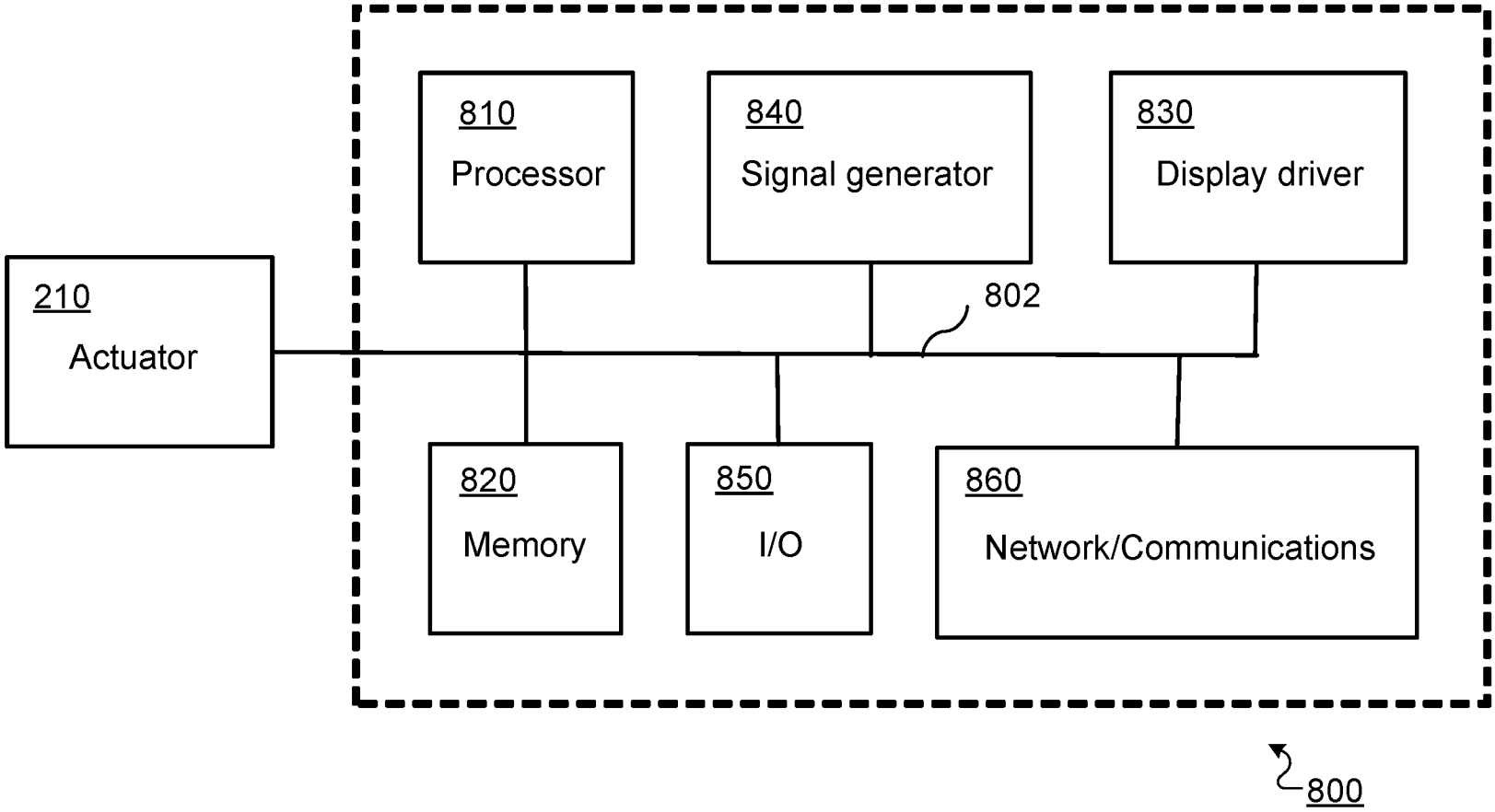
FIG. 8 is a schematic diagram of an embodiment of an electronic control module for a mobile device.

In general, the disclosed actuators are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 8, an exemplary electronic control module 800 of a mobile device, such as mobile phone 100, includes a processor 810, memory 820, a display driver 830, a signal generator 840, an input/output (I/O) module 850, and a network/communications module 860. These components are in electrical communication with one another (e.g., via a signal bus 802) and with actuator 210.

Processor 810 may be implemented as any electronic device capable of processing, receiving, or transmitting data or instructions. For example, processor 810 can be a microprocessor, a central processing unit (CPU), an application-specific integrated circuit (ASIC), a digital signal processor (DSP), or combinations of such devices.

Memory 820 has various instructions, computer programs or other data stored thereon. The instructions or computer programs may be configured to perform one or more of the operations or functions described with respect to the mobile device. For example, the instructions may be configured to control or coordinate the operation of the device's display via display driver 830, signal generator 840, one or more components of I/O module 850, one or more communication channels accessible via network/communications module 860, one or more sensors (e.g., biometric sensors, temperature sensors, accelerometers, optical sensors, barometric sensors, moisture sensors and so on), and/or actuator 210.

Signal generator 840 is configured to produce AC waveforms of varying amplitudes, frequency, and/or pulse profiles suitable for actuator 210 and producing acoustic and/or haptic responses via the actuator. Although depicted as a separate component, in some embodiments, signal generator 840 can be part of processor 810. In some embodiments, signal generator 840 can include an amplifier, e.g., as an integral or separate component thereof.

Memory 820 can store electronic data that can be used by the mobile device. For example, memory 820 can store electrical data or content such as, for example, audio and video files, documents and applications, device settings and user preferences, timing and control signals or data for the various modules, data structures or databases, and so on. Memory 820 may also store instructions for recreating the various types of waveforms that may be used by signal generator 840 to generate signals for actuator 210. Memory 820 may be any type of memory such as, for example, random access memory, read-only memory, Flash memory, removable memory, or other types of storage elements, or combinations of such devices.

As briefly discussed above, electronic control module 800 may include various input and output components represented in FIG. 8 as I/O module 850. Although the components of I/O module 850 are represented as a single item in FIG. 8, the mobile device may include a number of different input components, including buttons, microphones, switches, and dials for accepting user input. In some embodiments, the components of I/O module 850 may include one or more touch sensor and/or force sensors. For example, the mobile device's display may include one or more touch sensors and/or one or more force sensors that enable a user to provide input to the mobile device.

Each of the components of I/O module 850 may include specialized circuitry for generating signals or data. In some cases, the components may produce or provide feedback for application-specific input that corresponds to a prompt or user interface object presented on the display.

As noted above, network/communications module 860 includes one or more communication channels. These communication channels can include one or more wireless interfaces that provide communications between processor 810 and an external device or other electronic device. In general, the communication channels may be configured to transmit and receive data and/or signals that may be interpreted by instructions executed on processor 810. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 860 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the electronic device 100 to a mobile phone for output on that device and vice versa. Similarly, the network/communications module 860 may be configured to receive input provided on another device to control the mobile device. For example, an audible alert, visual notification, or haptic alert (or instructions therefore) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, or wearable devices (e.g., smartwatch or head-mounted device, such as smart glasses).

Other embodiments are in the following claims.

What is claimed is:

1. A device comprising:

an actuator attached to a panel and configured to couple vibrations to the panel to cause the panel to emit audio waves, the panel extending in a plane, the actuator comprising:

a frame;

a magnetic circuit assembly comprising a magnet and a voice coil, the magnet and voice coil being moveable relative to each other during operation of the actuator along an axis perpendicular to the panel's plane; and one or more suspension members attaching the frame to a first component of the magnetic circuit assembly, each suspension member comprising:

a segment attaching the suspension member to the frame, a first arm extending away from the segment to a first end attached to the first component of the magnetic circuit assembly, and a second arm extending away from the segment to a second end attached to the first component of the magnetic circuit assembly, the first and second ends being respectively attached to opposite sides of the first component of the magnetic assembly, and wherein during operation of the actuator the first arm and the second arm of the one or more suspension members flex to accommodate axial displacements of the magnet relative to the voice coil.

2. The device of claim 1, wherein a thickness of the first arm in the panel's plane is varied to reduce a concentration of stress at one or more locations of the one or more suspension members when the one or more suspension members flex during operation of the actuator.

3. The device of claim 1, wherein the first arm comprises a first straight segment extending away from the frame in a first direction in a first plane, parallel to the panel's plane, and a second straight segment connected to the first arm, the second straight segment extending in the first plane orthogonal to the first direction.

4. The device of claim 3, wherein the second straight segment has a thickness in the first plane that is tapered along the length of the second straight segment.

5. The device of claim 3, wherein the first arm comprises a first curved segment connecting the first straight segment and the second straight segment.

6. The device of claim 3, wherein the first arm comprises a third straight segment connected to the second straight segment by a second curved segment, the third straight segment extending in the first plane orthogonal to the second straight segment and the third straight segment being attached to the first component of the magnetic circuit assembly.

7. The device of claim 1, wherein the second arm extends away from the segment in a second direction, in a second plane parallel to the panel's plane.

8. The device of claim 7, wherein the first and second arms are connected by the segment attaching the suspension member to the frame, the segment comprising a vertical segment of the suspension member that extends in an axial direction.

9. The device of claim 8, wherein the first and second arms are respectively connected to opposing ends of the vertical segment by a corresponding curved segment, the corresponding curved segments extending out of the first and second planes, respectively.

10. The device of claim 9, wherein the vertical segment and two curved segments collectively form a C-shaped segment.

11. The device of claim 1, wherein the first component of the magnetic circuit assembly has a substantially polygonal shape in the panel's plane and a corresponding suspension member is attached to each respective side of the polygon.

12. The device of claim 11, wherein the polygon is a quadrilateral.

13. The device of claim 1, wherein the voice coil is attached to the frame and the first component of the magnetic circuit assembly comprises the magnet.

14. The device of claim 1, wherein the panel comprises a display panel.

15. The device of claim 1, wherein the end of the first arm attaches to a connection point on the first component of the magnetic circuit assembly.

16. The device of claim 1, wherein the first component of the magnetic circuit assembly forms a shape in the plane and the suspension member is attached to the outer perimeter of the shape.

17. The device of claim 1, wherein the actuator comprises four suspension members, each suspension member being unconnected from each other suspension member.

18. The device of claim 1, wherein the first and second arms are connected by the segment attaching the suspension member to the frame.

19. A mobile device comprising:

an electronic display panel extending in a plane;

a chassis attached to the electronic display panel and defining a space between a back panel of the chassis and the electronic display panel;

an electronic control module housed in the space, the electronic control module comprising a processor; and an actuator housed in the space and attached to a surface of the electronic display panel and configured to couple vibrations to the electronic display panel to cause the electronic display panel to emit audio waves, the actuator comprising:

a frame, a magnetic circuit assembly comprising a magnet and a voice coil, the magnet and voice coil being moveable relative to each other during operation of the actuator along an axis perpendicular to the panel's plane, and one or more suspension members attaching the frame to a first component of the magnetic circuit assembly, each suspension member comprising:

a segment attaching the suspension member to the frame, a first arm extending away from the segment to a first end attached to the first component of the magnetic circuit assembly, and a second arm extending away from the segment to a second end attached to the first component of the magnetic circuit assembly, the first and second ends being respectively attached to opposite sides of the first component of the magnetic assembly, and wherein during operation of the actuator the first arm and the second arm of the suspension member flex to accommodate axial displacements of the magnet relative to the voice coil.

20. A wearable device comprising:

an electronic display panel extending in a plane;

a chassis attached to the electronic display panel and defining a space between a back panel of the chassis and the electronic display panel;

an electronic control module housed in the space, the electronic control module comprising a processor; and an actuator housed in the space and attached to a surface of the electronic display panel and configured to couple vibrations to the electronic display panel to cause the electronic display panel to emit audio waves, the actuator comprising:

a frame, a magnetic circuit assembly comprising a magnet and a voice coil, the magnet and voice coil being moveable relative to each other during operation of the actuator along an axis perpendicular to the panel's plane, and one or more suspension members attaching the frame to a first component of the magnetic circuit assembly, each suspension member comprising:

a segment attaching the suspension member to the frame, a first arm extending away from the segment to a first end attached to the first component of the magnetic circuit assembly, and a second arm extending away from the segment to a second end attached to the first component of the magnetic circuit assembly, the first and second ends being respectively attached to opposite sides of the first component of the magnetic assembly, and wherein during operation of the actuator the first arm and the second arm of the suspension member flex to accommodate axial displacements of the magnet relative to the voice coil.

* * * * *